US010974928B2

(12) United States Patent
Shuai

(10) Patent No.: US 10,974,928 B2
(45) Date of Patent: Apr. 13, 2021

(54) ELEVATOR EMERGENCY OPERATION DEVICE

(71) Applicant: Otis Elevator Company, Farmington, CT (US)

(72) Inventor: Jie Shuai, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 574 days.

(21) Appl. No.: 15/750,721

(22) PCT Filed: Aug. 5, 2016

(86) PCT No.: PCT/US2016/045824
§ 371 (c)(1),
(2) Date: Feb. 6, 2018

(87) PCT Pub. No.: WO2017/027394
PCT Pub. Date: Feb. 16, 2017

(65) Prior Publication Data

US 2019/0002236 A1 Jan. 3, 2019

(30) Foreign Application Priority Data

Aug. 7, 2015 (CN) ..... 201510479452.7

(51) Int. Cl.
*B66B 1/46* (2006.01)
*B66B 5/00* (2006.01)
*B66B 11/00* (2006.01)

(52) U.S. Cl.
CPC ..... *B66B 1/466* (2013.01); *B66B 5/0087* (2013.01); *B66B 11/001* (2013.01)

(58) Field of Classification Search
CPC ..... B66B 1/466; B66B 5/0087; B66B 11/001
See application file for complete search history.

(56) References Cited

U.S. PATENT DOCUMENTS 6,029,778 A 2/2000 Lacarte Estallo
6,405,834 B1 6/2002 Chida et al.
(Continued)

FOREIGN PATENT DOCUMENTS

CN 202924502 U 5/2013
CN 104176573 A 12/2014
(Continued)

OTHER PUBLICATIONS

International Search Report for application PCT/US2016/045824, dated Jan. 4, 2017, 13 pages.
(Continued)

*Primary Examiner* — Jeffrey Donels
(74) *Attorney, Agent, or Firm* — Cantor Colburn LLP

(57) ABSTRACT

The present invention provides an elevator emergency operation device, comprising a box having an opening, an operation board, and a middle board. The operation board is provided with electronic devices thereon, and the face of the operation board provided with electronic devices is perpendicular to the plane on which the opening is located. Moreover, the operation board can be disposed inside the box in a manner that it can be pulled through the opening. The middle board is fixed, via a first side thereof, to the operation board, and the middle board is parallel to the plane on which the opening is located. An electric motor operation device, and an elevator apparatus comprising said electric motor emergency operation device or elevator operation device are further provided.

17 Claims, 3 Drawing Sheets

(56) References Cited

U.S. PATENT DOCUMENTS

| | | | |
|---|---|---|---|
| 7,114,594 | B2 | 10/2006 | Rossignol |
| 7,398,861 | B2 | 7/2008 | Rossignol et al. |
| 2006/0054421 | A1 | 3/2006 | Ikeda |
| 2012/0304550 | A1 | 12/2012 | Teixeira |
| 2012/0305337 | A1 | 12/2012 | Hopp et al. |
| 2014/0224591 | A1 | 8/2014 | Edy |

FOREIGN PATENT DOCUMENTS

| | | | |
|---|---|---|---|
| CN | 204111097 | U | 1/2015 |
| CN | 104418187 | A | 3/2015 |
| EP | 1148018 | A1 | 10/2001 |
| EP | 1422181 | A1 | 5/2004 |
| EP | 2292544 | A1 | 3/2011 |
| GR | 1004452 | B | 2/2004 |
| JP | H1036022 | A | 2/1998 |
| JP | H1087206 | A | 4/1998 |
| JP | 2000318940 | A | 11/2000 |
| JP | 2001240345 | A | 9/2001 |
| JP | 2003335475 | A | 11/2003 |
| JP | 2010208724 | A | 9/2010 |
| WO | 02081353 | A1 | 10/2002 |
| WO | 2004046010 | A1 | 6/2004 |

OTHER PUBLICATIONS

European Office Action for application EP16753537.6, dated Dec. 19, 2019, 8 pages.

ELEVATOR EMERGENCY OPERATION DEVICE

FIELD OF THE INVENTION

The present invention relates to elevator-related technologies, and more specifically, relates to an elevator emergency operation device.

DESCRIPTION OF THE RELATED ART

Elevator has been widely used. It is well known that an elevator requires routine maintenance. In case of any failure, repair is needed. If an elevator is equipped with a machine room for storing an elevator maintenance server and other related parts, it would be convenient for maintenance/repair staff.

To save space, no machine room is provided for some existing elevator devices. On the contrary, conventional elevator maintenance apparatuses and devices are placed together inside a wall close to the entrance to an elevator. For the purpose of saving space, moreover, the space provided on the wall for accommodating these apparatuses and devices is not big. As a result, it is not convenient for operators to perform maintenance.

The Chinese Patent Application with the publication number of CN1489547A discloses an operation device provided in the landing stage of an elevator. The solution locks a surface plate into a case for accommodating the surface plate by operating a lock, thereby preventing trouble caused by a mala fide third party. In the technical solution disclosed by the Chinese patent, the surface plate can be partially pulled out from the case with one side of the surface plate as an axis. Nevertheless, operations on the surface plate need to be made more convenient.

SUMMARY OF THE INVENTION

The present invention provides an elevator emergency operation device, which comprises a box having an opening, an operation board, and a middle board. The operation board is provided with electronic devices thereon, the face of the operation board provided with electronic devices is perpendicular to the plane on which the opening is located, and moreover, the operation board can be disposed inside the box in a manner that it can be pulled through the opening. The middle board is fixed, via a first side thereof, to the operation board, and the middle board is parallel to the plane on which the opening is located.

Optionally, regarding the elevator emergency operation device according to the present invention, a second side of the middle board opposite to the first side is used for binding with the back side of an elevator hall door button box, and the back side is opposite to the operation side of the hall door button box for an elevator user to operate.

Optionally, regarding the elevator emergency operation device according to the present invention, the maximum length and the maximum width of the projection of the operation board and the electronic devices on the plane on which the opening is located are smaller, respectively, than the height and the width of the hall door button box.

Optionally, regarding the elevator emergency operation device according to the present invention, the middle board is formed with a wire hole thereon to facilitate transmission lines of the hall door button box to run through.

Optionally, regarding the elevator emergency operation device according to the present invention, at least one face of the box perpendicular to the plane on which the opening is located is provided with a fixed sliding groove thereon, the operation board is provided with an extension portion, and the extension portion is embedded into the fixed sliding groove and can slide along the fixed sliding groove.

Optionally, regarding the elevator emergency operation device according to the present invention, the fixed sliding groove is provided with a stop portion at a position thereof close to the opening, the extension portion of the operation board is provided, at one end thereof that is away from the middle board, with a stop assisting portion for engagement with the stop portion.

Optionally, regarding the elevator emergency operation device according to the present invention, the stop portion is a hole formed on the fixed sliding groove, the stop assisting portion is an elastic member, when the elastic member encounters the hole as the extension portion slides along the fixed sliding groove to outside of the box, the elastic member recovers from the compressed state and snaps into the hole.

Optionally, regarding the elevator emergency operation device according to the present invention, all devices in the electronic devices are provided on the same face of the operation board.

Optionally, regarding the elevator emergency operation device according to the present invention, an emergency stop button in the electronic devices is provided on a first part of the face, a brake release button, a remote control switch on-off button, and a public button in the electronic devices are provided on a second part adjacent to the first part, an emergency electric operation switch and a socket in the electronic devices are provided on a third part adjacent to the second part, and a display in the electronic devices is provided on a fourth part adjacent to the third part.

Optionally, regarding the elevator emergency operation device according to the present invention, the first part is located at the topmost end of the face.

According to the present invention, an elevator operation device is further provided, which comprises an elevator emergency operation device and a hall door button box. The elevator emergency operation device comprises: a box having an opening; an operation board, provided with electronic devices thereon, and the face of the operation board provided with electronic devices is perpendicular to the plane on which the opening is located, wherein the operation board can be disposed inside the box in a manner that it can be pulled through the opening; and a middle board, fixed, via a first side thereof, to the operation board, and the middle board is parallel to the plane on which the opening is located. The back side of the hall door button box is installed on the middle board, such that the middle board is disposed between the hall door button box and the operation board, and the back side is a face opposite to the operation side of the hall door button box for an elevator user to operate.

Optionally, regarding the elevator operation device according to the present invention, the maximum length and the maximum width of the projection of the operation board and the electronic devices on the plane on which the opening is located are smaller, respectively, than the height and the width of the hall door button box.

Optionally, regarding the elevator operation device according to the present invention, the middle board is formed with a wire hole thereon to facilitate transmission lines of the hall door button box to run through.

Optionally, regarding the elevator operation device according to the present invention, at least one face of the box perpendicular to the plane on which the opening is located is provided with a fixed sliding groove thereon, the operation board is provided with an extension portion, and the extension portion is embedded into the fixed sliding groove and can slide along the fixed sliding groove.

Optionally, regarding the elevator operation device according to the present invention, the fixed sliding groove is provided with a stop portion at a position thereof close to the opening, the extension portion of the operation board is provided, at one end thereof that is away from the middle board, with a stop assisting portion for engagement with the stop portion.

Optionally, regarding the elevator operation device according to the present invention, the stop portion is a hole formed on the fixed sliding groove, the stop assisting portion is an elastic member, when the elastic member encounters the hole as the extension portion slides along the fixed sliding groove to outside of the box, the elastic member recovers from the compressed state and snaps into the hole.

The present invention further provides an elevator apparatus, which comprises the elevator emergency operation device described above.

The present invention further provides an elevator apparatus, which comprises the elevator operation device described above.

Regarding the elevator emergency operation device or the elevator operation device according to the present invention, the elevator emergency operation device may be pulled out of the case in which it is disposed, thereby facilitating operations by operators; moreover, the elevator emergency operation device may be disposed in a space reserved for an elevator hall door button box, making it unnecessary to open up an extra space and thereby saving space.

DETAILED DESCRIPTION OF THE SPECIFIC EMBODIMENTS

Exemplary examples of the present invention will be described with reference to the accompanying drawings, and the same numbers represent the same components. All examples described below will help those skilled in the art thoroughly understand the present invention, but are intended only as examples, rather than limitations. Components, parts, units and devices in the figures may not be depicted to scale, but only illustratively indicate the relative relation between these components, parts, modules and devices.

Almost every floor of an elevator is provided with a hall door button box for a user to take the elevator to call the elevator. The present invention provides an elevator emergency operation device, which may be combined with the hall door button box and disposed in the wall originally for holding the hall door button box. It should be noted that the elevator emergency operation device according to the present invention may be disposed only on one floor of the building in which the elevator is located, or may be disposed on a plurality of floors. In addition, electronic components involved in the elevator emergency operation device herein are substantially the same as the electronic components on an elevator emergency operation board known to those skilled in the art.

Figure 1:
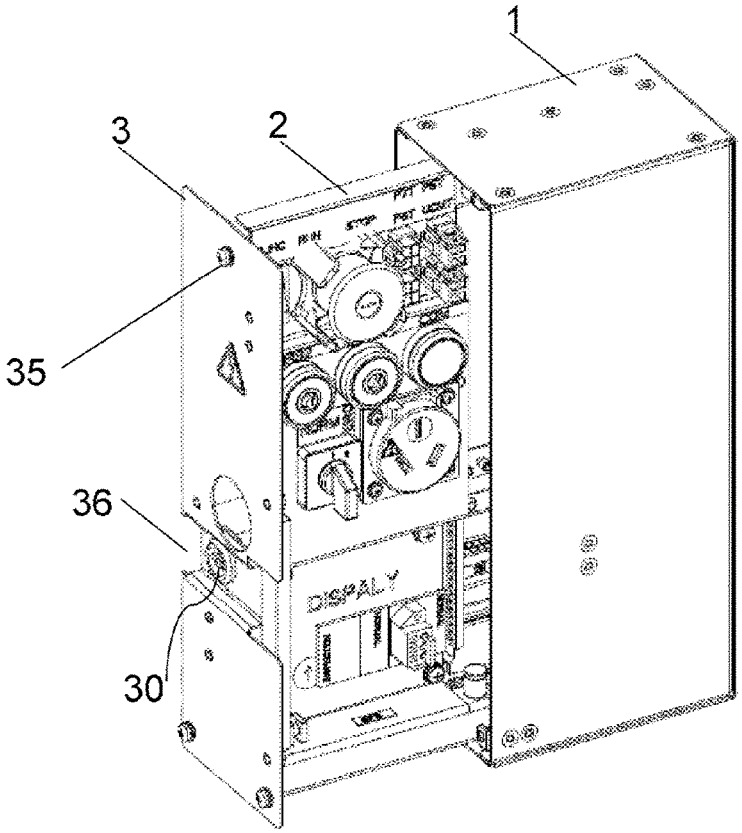
FIG. 1 is a schematic diagram of an elevator emergency operation device.

According to an example of the present invention, the elevator emergency operation device comprises a box 1, an operation board 2, and a middle board 3, as shown in FIG. 1. The box 1 has an opening (not shown), and the operation board 2 is placed into the box 1 via the opening. The operation board 2 is provided with electronic devices thereon, and the face of the operation board 2 provided with electronic devices is perpendicular to the plane on which the opening is located. In the description below, the face of the operation board 2 provided with electronic devices is also referred to as the electronic device installation face. The operation board 2 can be disposed inside the box 1 in a manner that it can be pulled through the opening, namely, the operation board 2 can be pulled out of the box 1 through the opening, or can be placed back into the box 1 through the opening.

The middle board 3 is fixed, via a first face thereof (not shown), to the operation board 2, and is perpendicular to the electronic device installation face. Due to operational error and other reasons, the term "perpendicular" allows a deviation of ±3 degrees herein. As shown in the figure, the middle board 3 is fixed, for example, via screws 35, to the end of the operation board 2 that is close to the opening of the box 1, such that a hall door button box may be fixed to the middle board 3. The middle board 3 is provided with a locking device 30 thereon, the locking device 30 is the same as a locking device in a conventional emergency operation device, which is used for locking the operation board 2 inside the box 1 when it is completely accommodated in the box 1, so as to prevent an unauthorized party from opening the emergency operation device. According to an example of the present invention, the part of the middle board 3 on which the locking device 30 is installed may protrude slightly toward the direction of the operation board, so as to form a stepped part 36 on the middle board 3, which allows an operator to exert a force through the stepped part to pull the operation board 2. As a result, there is no need for provision of an extra handle to pull the operation board.

Figure 2:
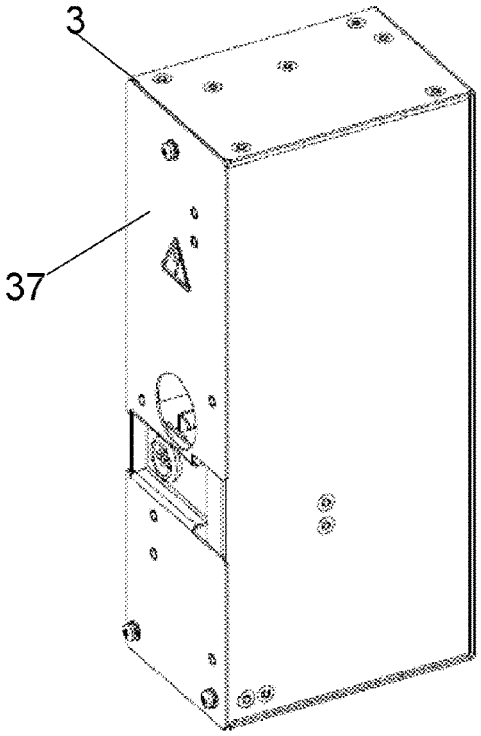
FIG. 2 is a schematic diagram of the elevator emergency operation device when the operation board 2 is completely accommodated in the box 1.

FIG. 2 is a schematic diagram of the elevator emergency operation device when the operation board 2 is completely accommodated in the box 1. According to an example of the present invention, the second face 37 of the middle board 3 that is opposite to the first face is used for combining with the back side of a hall door button box of the elevator.

Figure 3:
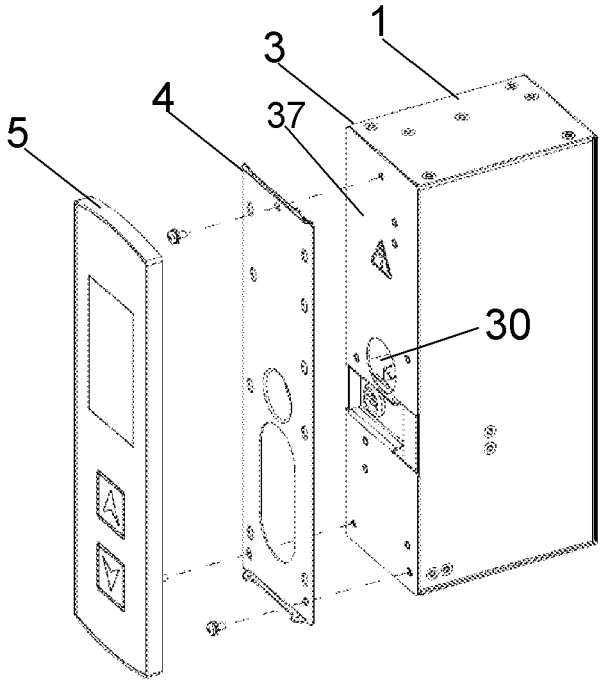
FIG. 3 is an exploded view of the hall door button box attached to a second face 37.

FIG. 3 is an exploded view of the hall door button box attached to the second face 37. As shown in FIG. 3, the second face 37 faces the back side 4 of the hall door button box. In the present example, the middle board 3 further comprises a wire hole 30 to facilitate transmission lines of the hall door button box to run through. As an example, after running through the wire hole 30, the transmission lines are arranged through the space between the operation board 2 and the box 1, and lastly reach corresponding control apparatuses via the box 1.

As shown in FIG. 3, the back side 4 of the hall door button box is fixed, for example, via screws, to the middle board 3, and the operation surface 5 of the hall door button box is combined with the back side 4. The manner in which the hall door button box and the middle board 3 are combined is not limited by the example shown in FIG. 4, and any combination manner that can combine the hall door button box and the middle board 3 is feasible, for example, the hall door button box and the middle board 3 are combined by means of a fastener.

In an existing elevator device, the hall door button box would be installed in a space reserved therefor on the wall at the elevator hall door. Therefore, a fixing structure that matches the installation part already provided on the hall door button box for installation into the reserved space may be provided on the middle board 3. As a result, there is no need to make adjustments to the electrical configuration of the existing hall door button box, and moreover, there is no need to modify the entire mechanical structure of the hall door button box.

Figure 4:
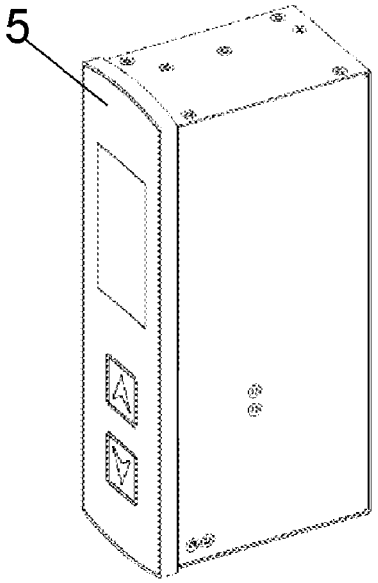
FIG. 4 is a schematic diagram of the hall door button box and the elevator emergency operation device in the present example after being combined as a whole.

FIG. 4 is a schematic diagram of the hall door button box and the elevator emergency operation device in the present example after being combined as a whole. As shown in the figure, the back side of the hall door button box is no longer visible from outside, while the operation surface 5 remains outside of the box 1 to facilitate operations.

Figure 5:
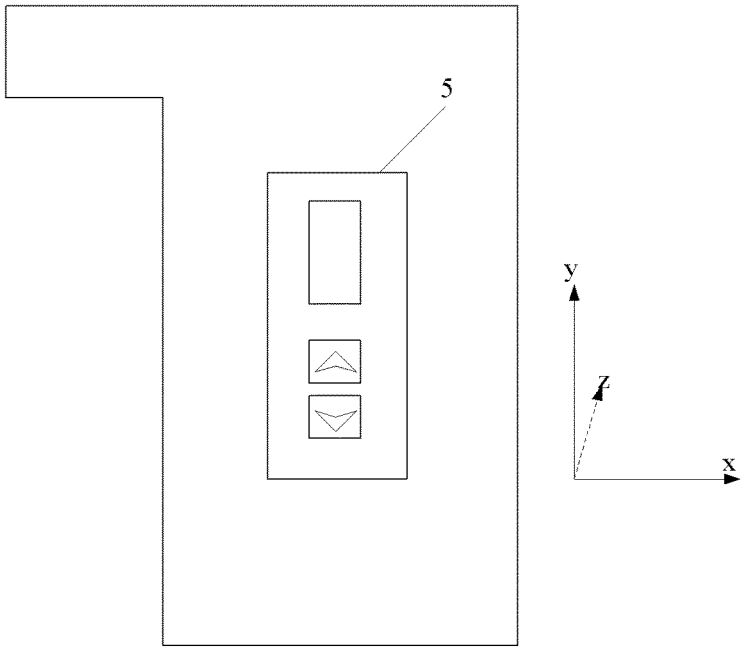
FIG. 5 is a schematic diagram of the coordinate of the operation surface 5 based on the hall door button box of the present invention.

For the purpose of convenient description, FIG. 5 is a schematic diagram of the coordinate of the operation surface 5 based on the hall door button box of the present invention. As shown in FIG. 5, the x-axis is the width direction of the "reserved wall space for accommodating the hall door button box", the y-axis is the height direction of the "reserved wall space for accommodating the hall door button box", and the z-axis perpendicular to the plane on which the x-axis and the y-axis are located is the depth direction of the "reserved wall space for accommodating the hall door button box"; for the purpose of consistency in the description, the length of the side of the hall door button box in the x-axis direction is referred to as width, and the length of the side of the hall door button box in the y-axis direction is referred to as height herein.

In summary, according to an example of the present invention, since the electronic devices are arranged on the electronic device installation face of the operation board 2 in the depth direction of the box 1, at least one of the width direction and the height direction of the existing reserved wall space for accommodating the hall door button box does not need to be modified.

Furthermore, according to an example of the present invention, electronic devices are arranged on the operation board 2 in such a manner, namely, the maximum length and the maximum width of the projection of the operation board 2 and the electronic devices thereon on the plane on which the opening is located are smaller, respectively, than the height and the width of the hall door button box. On the basis of such an arrangement, there is no need to change the existing reserved wall space for accommodating the hall door button box in either the width direction or the height direction thereof. As a specific exemplary example, all devices in the electronic devices are provided on the same face of the operation board, namely the electronic device installation face is a face of the operation board. In said example, an emergency stop button in the electronic devices is provided on a first part of the electronic device installation face, a brake release button, a remote control switch on-off button, and a public button in the electronic devices are provided on a second part adjacent to the first part, an emergency electric operation switch and a socket in the electronic devices are provided on a third part adjacent to the second part, and a display in the electronic devices is provided on a fourth part adjacent to the third part. Wherein, the first part is located at the topmost end of the electronic device installation face. In other words, from top to bottom of the electronic device installation face, it is the first part, the second part, the third part, and the fourth part, respectively. The elevator emergency operation device according to the specific example can be substantially accommodated into the existing reserved wall space for accommodating the hall door button box.

Figure 6:
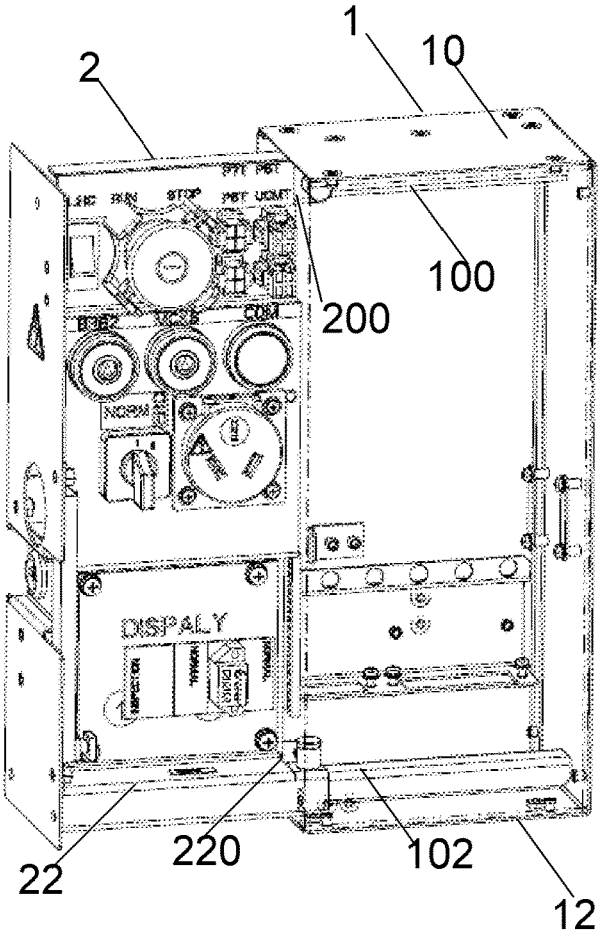
FIG. 6 is a schematic diagram of the internal structure of the box 1.

The structure between the operation board 2 and the box 1 will be described below in an exemplary, instead of a limiting, way. Referring to FIG. 6, it illustrates the internal structure of the box 1. FIG. 6 illustrates the situation in which the operation board 2 is pulled out of the box 1. As shown in the figure, the internal surface of the top face 10 of the box 1 is provided with a first fixed sliding groove 100, and the internal surface of the bottom face 12 of the box 1 is provided with a second fixed sliding groove 102. The operation board 2 comprises a first extension portion (not shown) and a second extension portion 22. Wherein, the first extension portion is provided on the top of the operation board 2 for being embedded into the first fixed sliding groove 100, and the second extension portion 22 is provided on the bottom of the operation board 2 for being embedded into the second fixed sliding groove 102. The first extension portion and the second extension portion 22 may slide along the first fixed sliding groove 100 and the second fixed sliding groove 102, respectively; when not sliding, they are fixed by the first fixed sliding groove 100 and the second fixed sliding groove 102, respectively. The combination of the first extension portion and the first fixed sliding groove 100, and the combination of the second extension portion 22 and the second fixed sliding groove 102 are similar to the combination of a guide rail and a guide channel. With the provision of the extension portions and the fixed sliding grooves, the operation board 2 may slide in the box 1, such that it can be pulled out of and placed back into the box.

Furthermore, the fixed sliding groove is provided with a stop portion at a position thereof close to the opening, the extension portion of the operation board is provided, at one end thereof that is away from the middle board, with a stop assisting portion for engagement with the stop portion. When the operation board slides out of the box, for example, the operation board slides out to the end thereof that is the farthest from the middle board, the stop portion and the stop assisting portion engage with each other to prevent the operation board from continuing to slide. In such a way, it can prevent the operation board from dropping out of the box. It should be noted that the installation positions of the stop portion and the stop assisting portion may be determined according to the position where the operation board is required to sop sliding in an actual application.

As an example, the stop portion is a hole formed on the fixed sliding groove, the stop assisting portion is an elastic member, when the elastic member encounters the hole as the extension portion slides along the fixed sliding groove to outside of the box, the elastic member recovers from the compressed state and snaps into the hole.

Back to FIG. 6, regarding the elevator emergency operation device in such a state, the elastic member 200 provided on the first extension portion has recovered from the compressed state and snapped into the hole (not shown) located at a position of the first fixed sliding groove 100 that is close to the opening, and similarly, the elastic member 220 provided on the second extension portion 22 has recovered from the compressed state and snapped into the hole (not shown) located at a position of the second fixed sliding groove 102 that is close to the opening.

In the above exemplary description with reference to FIG. 6, two fixed sliding grooves are provided for the description. In an actual application, only one fixed sliding groove may be provided, and correspondingly, only one extension portion may be provided on the operation board. In addition, the installation position of the fixed sliding groove may not be limited to the top face or bottom face of the box 1. As an example, the extension portion of the operation board may be provided on the face of the operation board opposite to the electronic device installation face, while the fixed sliding groove is correspondingly provided on the internal surface of a side face of the box corresponding to said face.

The elevator emergency operation device according to an example of the present invention can be installed in a reserved space for accommodating the hall door button box, and the hall door button box is combined thereon. In such a way, an elevator may be equipped with the elevator emergency operation device with no need to open up an extra space to accommodate the device.

According to the present invention, an elevator operation device is further provided, which comprises the elevator emergency operation device described in the example above, and a hall door button box that is combined to the elevator emergency operation device. The combination of the hall door button box and the elevator emergency operation device is as described above. As a result, the provided elevator operation device is as shown in FIG. 4.

According to the present invention, an elevator apparatus is further provided, which comprises the elevator emergency operation device described in the example above.

Although specific embodiments of the present invention have been disclosed with reference to the accompanying drawings in the description above, those skilled in the art should understand that the disclosed specific embodiments may be varied or modified without departing from the spirit of the present invention. embodiments of the present invention are only used to illustrate, rather than limit, the present invention.

The invention claimed is:

1. An elevator emergency operation device, characterized in that the elevator emergency operation device comprises:
- a box having an opening;
- an operation board, provided with electronic devices thereon, and the face of the operation board provided with electronic devices is perpendicular to the plane on which the opening is located, wherein the operation board can be disposed inside the box in a manner that it can be pulled through the opening; and
- a middle board, fixed, via a first side thereof, to the operation board, and the middle board is parallel to the plane on which the opening is located;
- characterized in that a second side of the middle board is used for binding with the back side of an elevator hall door button box, the back side is opposite to the operation side of the hall door button box for an elevator user to operate, and the second side is opposite to the first side.

2. The elevator emergency operation device according to claim 1, characterized in that the maximum length and the maximum width of the projection of the operation board and the electronic devices on the plane on which the opening is located are smaller, respectively, than the height and the width of the hall door button box.

3. The elevator emergency operation device according to claim 1, characterized in that the middle board is formed with a wire hole thereon to facilitate transmission lines of the hall door button box to run through.

4. The elevator emergency operation device according to claim 1, characterized in that at least one face of the box perpendicular to the plane on which the opening is located is provided with a fixed sliding groove thereon, the operation board is provided with an extension portion, and the extension portion is embedded into the fixed sliding groove and can slide along the fixed sliding groove.

5. An elevator emergency operation device, characterized in that the elevator emergency operation device comprises:
- a box having an opening;
- an operation board, provided with electronic devices thereon, and the face of the operation board provided with electronic devices is perpendicular to the plane on which the opening is located, wherein the operation board can be disposed inside the box in a manner that it can be pulled through the opening; and
- a middle board, fixed, via a first side thereof, to the operation board, and the middle board is parallel to the plane on which the opening is located;
- characterized in that at least one face of the box perpendicular to the plane on which the opening is located is provided with a fixed sliding groove thereon, the operation board is provided with an extension portion, and the extension portion is embedded into the fixed sliding groove and can slide along the fixed sliding groove;
- characterized in that the fixed sliding groove is provided with a stop portion at a position thereof close to the opening, the extension portion of the operation board is provided, at one end thereof that is away from the middle board, with a stop assisting portion for engagement with the stop portion.

6. The elevator emergency operation device according to claim 5, characterized in that the stop portion is a hole formed on the fixed sliding groove, the stop assisting portion is an elastic member, when the elastic member encounters the hole as the extension portion slides along the fixed sliding groove to outside of the box, the elastic member recovers from the compressed state and snaps into the hole.

7. The elevator emergency operation device according to claim 6, characterized in that all devices in the electronic devices are provided on the same face of the operation board.

8. The elevator emergency operation device according to claim 7, characterized in that an emergency stop button in the electronic devices is provided on a first part of the face, a brake release button, a remote control switch on-off button, and a public button in the electronic devices are provided on a second part adjacent to the first part, an emergency electric operation switch and a socket in the electronic devices are provided on a third part adjacent to the second part, and a display in the electronic devices is provided on a fourth part adjacent to the third part.

9. The elevator emergency operation device according to claim 8, characterized in that the first part is located at the topmost end of the face.

10. An elevator operation device, characterized in that it comprises:
- an elevator emergency operation device, comprising:
  - a box having an opening;
  - an operation board, provided with electronic devices thereon, and the face of the operation board provided with electronic devices is perpendicular to the plane on which the opening is located, wherein the operation board can be disposed inside the box in a manner that it can be pulled through the opening; and a middle board, fixed, via a first side thereof, to the operation board, and the middle board is parallel to the plane on which the opening is located; and a hall door button box, the back side thereof is installed on the middle board, such that the middle board is disposed between the hall door button box and the operation board, and the back side is a face opposite to the operation side of the hall door button box for an elevator user to operate.

11. The elevator operation device according to claim 10, characterized in that the maximum length and the maximum width of the projection of the operation board and the electronic devices on the plane on which the opening is located are smaller, respectively, than the height and the width of the hall door button box.

12. The elevator operation device according to claim 10, characterized in that the middle board is formed with a wire hole thereon to facilitate transmission lines of the hall door button box to run through.

13. The elevator operation device according to claim 10, characterized in that at least one face of the box perpendicular to the plane on which the opening is located is provided with a fixed sliding groove thereon, the operation board is provided with an extension portion, and the extension portion is embedded into the fixed sliding groove and can slide along the fixed sliding groove.

14. The elevator operation device according to claim 13, characterized in that the fixed sliding groove is provided with a stop portion at a position thereof close to the opening, the extension portion of the operation board is provided, at one end thereof that is away from the middle board, with a stop assisting portion for engagement with the stop portion.

15. The elevator operation device according to claim 14, characterized in that the stop portion is a hole formed on the fixed sliding groove, the stop assisting portion is an elastic member, when the elastic member encounters the hole as the extension portion slides along the fixed sliding groove to outside of the box, the elastic member recovers from the compressed state and snaps into the hole.

16. An elevator apparatus, comprising the elevator emergency operation device according to claim 1.

17. An elevator apparatus, comprising the elevator operation device according to claim 10.

* * * * *